US012123290B2

(12) United States Patent
Batita et al.

(10) Patent No.: US 12,123,290 B2
(45) Date of Patent: Oct. 22, 2024

(54) SYSTEM AND METHOD FOR STIMULATING MULTIPLE ZONES

(71) Applicant: Schlumberger Technology Corporation, Sugar Land, TX (US)

(72) Inventors: Nabil Ben Mohamed Batita, Houston, TX (US); Wesley Ryan Atkinson, Cypress, TX (US); Balkrishna Gadiyar, Katy, TX (US); Maye Ezekiel Beldongar, Brookshire, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/264,293

(22) PCT Filed: Jan. 18, 2022

(86) PCT No.: PCT/US2022/012793
§ 371 (c)(1),
(2) Date: Aug. 4, 2023

(87) PCT Pub. No.: WO2022/169588
PCT Pub. Date: Aug. 11, 2022

(65) Prior Publication Data

US 2024/0102370 A1 Mar. 28, 2024

Related U.S. Application Data

(60) Provisional application No. 63/146,247, filed on Feb. 5, 2021.

(51) Int. Cl.
*E21B 43/14* (2006.01)
*E21B 43/04* (2006.01)
(Continued)

(52) U.S. Cl.
CPC ..... *E21B 43/14* (2013.01); *E21B 43/04* (2013.01); *E21B 43/10* (2013.01); *E21B 43/27* (2020.05)

(58) Field of Classification Search
CPC ..... E21B 43/14; E21B 43/27; E21B 43/04; E21B 43/10
See application file for complete search history.

(56) References Cited

U.S. PATENT DOCUMENTS 5,595,246 A 1/1997 Voll
6,230,801 B1 5/2001 Hill, Jr.
(Continued)

FOREIGN PATENT DOCUMENTS

EP 0421822 A2 4/1991
RU 2008132763 A 2/2010
(Continued)

OTHER PUBLICATIONS

International Search Report and Written Opinion issued in PCT Application PCT/US2011/064090, dated Aug. 31, 2012 (8 pages).
(Continued)

*Primary Examiner* — D. Andrews
(74) *Attorney, Agent, or Firm* — Jeffrey D. Frantz

(57) ABSTRACT

A technique facilitates stimulation of multiple well zones along a multilayered reservoir. The technique utilizes equipment constructed to enable performance of the stimulation job along the multiple well zones, i.e. two or more well zones, prior to gravel packing the multiple well zones. The equipment enables performance of the stimulation job during a single trip downhole. Subsequent actuation of the equipment further enables a multizone gravel packaging operation during the same trip downhole.

10 Claims, 10 Drawing Sheets

(51) Int. Cl.
*E21B 43/10* (2006.01)
*E21B 43/27* (2006.01)

(56) References Cited

U.S. PATENT DOCUMENTS

| | | | | |
|---|---|---|---|---|
| 6,675,891 | B2 | 1/2004 | Hailey, Jr. | |
| 6,907,930 | B2 | 6/2005 | Cavender | |
| 7,934,553 | B2 * | 5/2011 | Malone | E21B 43/08 166/278 |
| 8,245,782 | B2 * | 8/2012 | Sanchez | E21B 43/04 166/278 |
| 2002/0189808 | A1 | 12/2002 | Nguyen | |
| 2003/0000702 | A1 | 1/2003 | Streich | |
| 2003/0066651 | A1 | 4/2003 | Johnson | |
| 2003/0141060 | A1 | 7/2003 | Hailey | |
| 2004/0035579 | A1 | 2/2004 | Parlar | |
| 2006/0231253 | A1 | 10/2006 | Vilela | |
| 2008/0308274 | A1 | 12/2008 | MacDougall | |
| 2009/0283279 | A1 | 11/2009 | Patel et al. | |
| 2010/0300687 | A1 | 12/2010 | Watson et al. | |
| 2010/0314109 | A1 | 12/2010 | Garcia et al. | |
| 2011/0073308 | A1 | 3/2011 | Assal | |
| 2011/0162840 | A1 | 7/2011 | Haeberle | |
| 2012/0018153 | A1 | 1/2012 | Yeh | |
| 2012/0175112 | A1 | 7/2012 | Atkinson | |
| 2013/0008645 | A1 | 1/2013 | Wetzel | |
| 2014/0076580 | A1 | 3/2014 | Holderman | |
| 2014/0116693 | A1 | 5/2014 | Broussard | |
| 2020/0149378 | A1 | 5/2020 | van Petegem | |

FOREIGN PATENT DOCUMENTS

| | | | |
|---|---|---|---|
| WO | 2010147788 | A1 | 12/2010 |
| WO | 2012096738 | A2 | 9/2012 |

OTHER PUBLICATIONS

The Oilfield Glossary, 2014, Schlumberger Limited (glossary. Oilfield. slb.com)—Shut-in bottomhole pressure (1 page).
The Oilfield Glossary, 2014, Schlumberger Limited (glossary. Oilfield. slb.com)—Hydrostatic Pressure (1 page).
Merriam-Webstar Dictionary, 2014, Merriam-Webstar, Incorporated (www.merriam-webstar.com)—Hydrostatic Pressure (1 page).
Hydrostatic Pressure, (n.d.) The American Heritage Science Dictionary, 2002, from Dictionary. Com, website: http://dictionary. reference.com/browse/hydrostatic+pressure.
Merriam-Webstar: Definition of releasing, Definition of Maintaining, accessed Mar. 2017, https://www.merriam-webstar.com/.
Allfrac (2014), downloaded on Aug. 3, 2023, from link https:// www.slb.com/-/media/files/sand-control/product-sheet/allfrac-ps. ashx (2 pages).
International Search Report and Written Opinion issued in PCT Application PCT/US2022/012793, dated Apr. 22, 2022 (11 pages).

* cited by examiner

SYSTEM AND METHOD FOR STIMULATING MULTIPLE ZONES

CROSS-REFERENCE TO RELATED APPLICATIONS

The present application is the National Stage Entry of International Application No. PCT/US2022/012793, filed Jan. 18, 2022, which claims priority benefit of U.S. Provisional Application No. 63/146,247, filed Feb. 5, 2021, the entirety of which is incorporated by reference herein and should be considered part of this specification.

BACKGROUND

In a variety of well applications, gravel packing operations are performed across multiple well zones along a wellbore. Gravel packing equipment is deployed downhole via a suitable well string to facilitate gravel packing along the wellbore between the well string and the surrounding casing along the wellbore wall. Prior to the gravel packing operation, it is sometimes useful to perform a well stimulation operation in the form of an acid stimulation or other selected stimulation treatment to facilitate subsequent production operations. Certain types of gravel packing equipment and techniques enable performance of multizone gravel pack operations. However, these techniques do not permit the well stimulation operation over all of the well zones during a single trip downhole. Instead, the operational sequence is limited to performance of, at most, a stimulation job over a single zone, e.g. the uppermost well zone, prior to commencing pumping of the gravel pack job.

SUMMARY

In general, a system and methodology enable stimulation of the multiple well zones along a multilayered reservoir. The technique utilizes equipment constructed to enable performance of the stimulation job along the multiple well zones, i.e. two or more well zones, prior to gravel packing the multiple well zones. Effectively, the technique and equipment simplify well operations by enabling performance of the multizone stimulation job during a single trip downhole and then allowing subsequent actuation of the equipment to also enable a multizone gravel packing operation during the same trip downhole and with a single pumping treatment.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for enabling stimulation of the multiple well zones along a multilayered reservoir. Tools and techniques are constructed and selected to enable stimulation of more than one well zone in a single trip downhole prior to performing a gravel packing job. According to an embodiment, the technique utilizes equipment constructed to enable performance of the stimulation job along all of the well zones, i.e. two or more well zones, prior to gravel packing. In this example, the well equipment enables performance of the multizone stimulation job during a single trip downhole and then allows subsequent actuation of the well equipment to further enable a multizone gravel packing operation during the same trip downhole and with a single pumping treatment.

Figure 1:
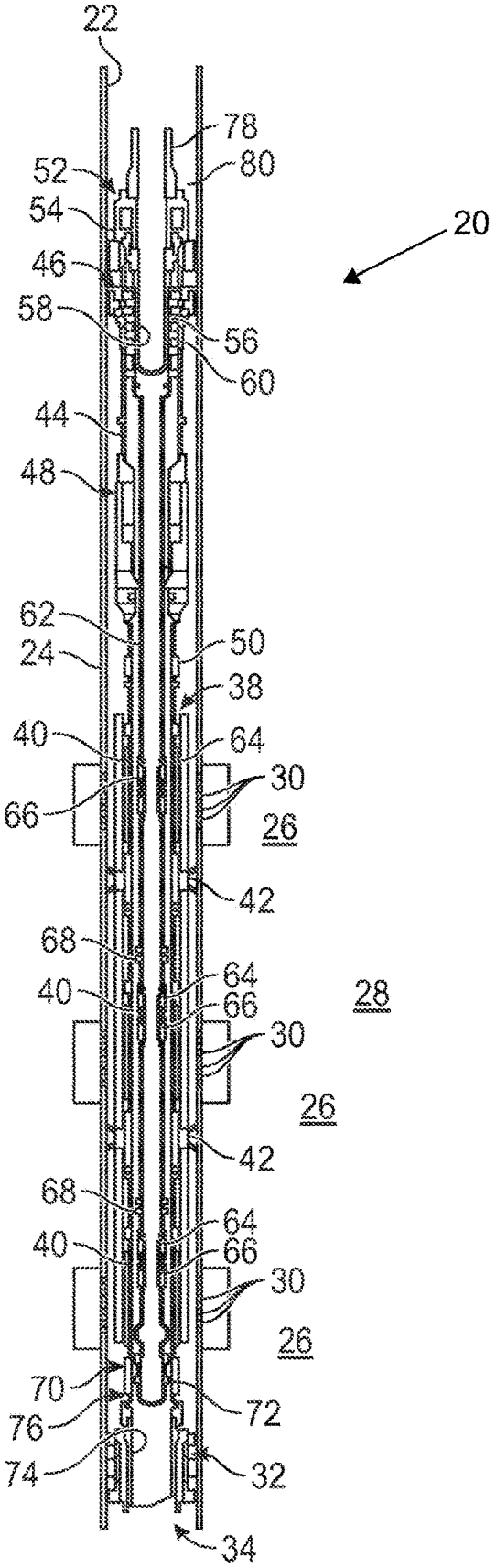
FIG. 1 is an illustration of an example of a well string deployed in a borehole for use in a multizone stimulation and gravel packing operation, according to an embodiment of the disclosure.

Referring generally to FIG. 1, an example of a well system 20 is illustrated as deployed in a borehole 22, e.g. a wellbore, lined with a casing 24. In the illustrated embodiment, wellbore 22 extends through a plurality of well zones 26, e.g. two or more well zones, in a multilayered reservoir 28. Fluid communication between the interior of casing 24 and the surrounding well zones 26 may be achieved via ports 30 formed laterally through casing 24 via perforations or other suitable mechanisms. A lower packer 32, e.g. a sump packer, may be positioned in casing 24 downhole from the well zones 26 to receive a bottom hole assembly 34 which may comprise a variety of components depending on the parameters of a given downhole operation or operations.

According to an embodiment, well system 20 may comprise various types of equipment arranged in a well string to enable both a multizone well stimulation and multizone gravel packing operation during the same trip downhole and prior to production. By way of example, well string/equipment may comprise a sand screen assembly 38 having sand screens 40 which may be positioned for use at each of the well zones 26. The sand screen assembly 38 may be used in cooperation with other components, such as packers 42 which provide zonal isolation within casing 24 and between the well zones 26. In some embodiments, the sand screen assembly 38 may be carried downhole via suitable tubing 44 which extends up into engagement with a gravel pack packer 46. Other components may be positioned along tubing 44, such as an isolation valve 48 and a shear out safety joint 50.

Referring again to FIG. 1, the well equipment may further comprise a gravel pack service tool 52 which may be releasably received in gravel pack packer 46. By way of example, the gravel pack service tool 52 may comprise a setting module 54, a crossover module 56 constructed with a crossover ported body, and a set down module 58, such as an I-slot set down module, coupled with a valve 60 to control the opening and closing of valve 60. In this example, the gravel pack service tool 52 is connected with tubing 62, e.g. a wash pipe, which extends down through the interior of tubing 44 and sand screen assembly 38.

Various components may be positioned along tubing 62. For example, a plurality of nozzle subs 64 may be positioned along tubing 62 proximate corresponding sand screens 40. Each of the nozzle subs 64 may comprise an appropriate nozzle or nozzles 66 selected and sized to control injection of stimulation fluid into the surrounding well zones 26. For example, the nozzles 66 may be selected so that the injected volume of fluid between the well zones 26 is balanced.

Other components which may be positioned along tubing 62 include seal units 68 which may be positioned to form seals with the surrounding tubing 44 or with other surrounding components, e.g. with the interior of isolation packers 42, so as to enable isolated injection of stimulation fluid into the appropriate, corresponding well zones 26. The tubing 62 also may be coupled with a lower seal unit 70 sized for receipt in a polished bore receptacle 72. The polished bore receptacle 72 may be coupled with tubing 44 proximate a lower coupling mechanism 74 received in lower packer 32 as illustrated. In some embodiments, the tubing 62 also may comprise or work in cooperation with a check valve sub 76.

In an operational example, the well string/equipment is run in hole via tubing 78, e.g. drill pipe, to a treatment depth and the bottom hole assembly 34/lower coupling mechanism 74 is coupled into the lower packer 32 where depth may be confirmed. It should be noted the I-slot set down module 58 is initially locked in an open position and later activated to a closed position prior to commencing gravel pack operations down through the interior of gravel pack service tool 52. Once the proper depth is confirmed, a rig up of surface lines and a pressure test of the lines may be performed. At this stage, a setting sequence may be started for gravel pack packer 46 by blocking fluid flow down through the interior of gravel pack service tool 52 to enable pressuring up for setting of packer 46.

The blocking of flow along the interior of gravel pack service tool 52 may be achieved via a setting ball allowed to gravitate and reach an appropriate ball seat, e.g. a ball seat in crossover module 56, or via other mechanisms able to temporarily seal off the interior of service tool 52. An example of a gravel pack packer setting sequence comprises pressuring up at increments, e.g. 500 psi increments, to a predetermined set pressure and then holding the set pressure for a predetermined time period, e.g. 15 minutes. A pull push test may then be performed to ensure the gravel pack packer 46 has been properly set. A packer back side pressure test also may be performed.

At the next stage, the gravel pack service tool 52 may be released from gravel pack packer 46 by pressuring up to an increased pressure level within the gravel pack service tool 52. By way of example, the pressure level may be increased to 2800 psi or other suitable pressure and held for a predetermined time period, e.g. five minutes, before bleeding off the pressure. This sequence releases the gravel pack service tool 52 and the release may be confirmed by pulling up on the service tool 52. It should be noted that the various pressure levels and time periods for setting the packer, testing the packer, releasing the service tool, or performing other tasks are provided merely as examples and other pressure levels and time periods may be utilized depending on various parameters of the equipment and operation.

Figure 2:
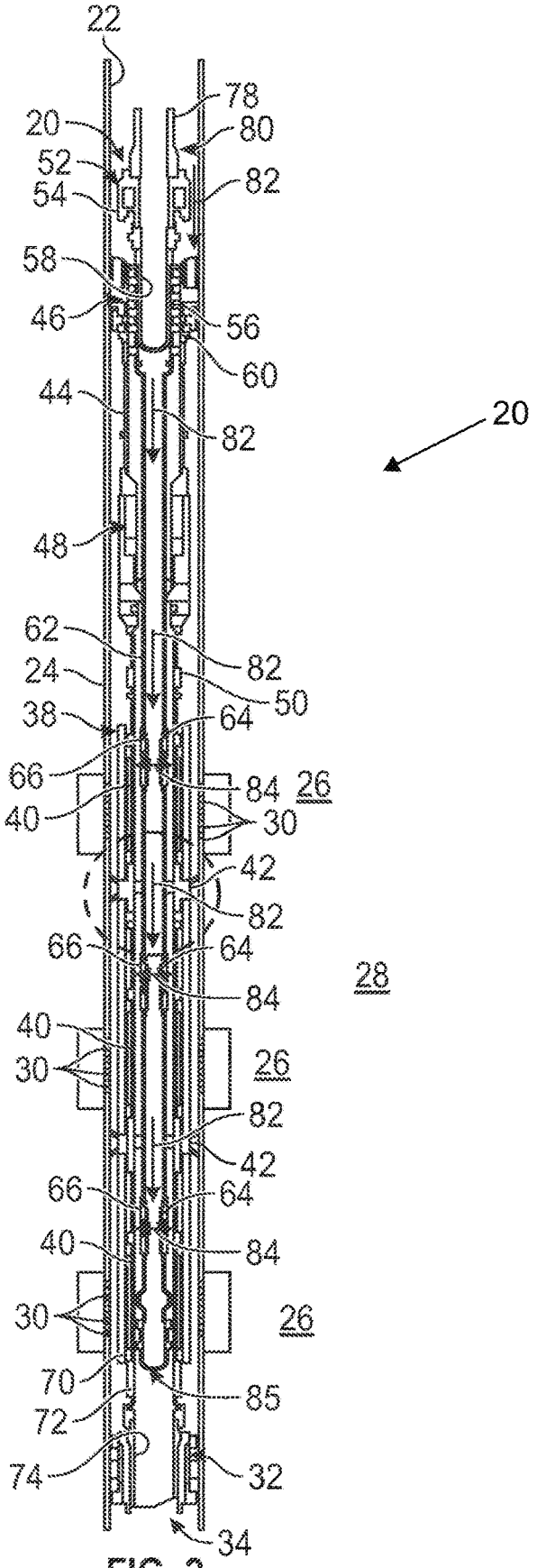
FIG. 2 is an illustration similar to that of FIG. 1 but showing the well string in a different operational position, according to an embodiment of the disclosure.

In FIG. 2, the gravel pack service tool 52 is illustrated as released from gravel pack packer 46. At this stage, different tool positions of service tool 52 may be identified, and then the gravel pack service tool 52 may be placed in a reverse flow position. If a ball and ball seat have been used, sufficient pressure may be applied to blow the ball seat and to thus free the flow path of the crossover ported body so that fluid flow may be conducted down through the exterior of gravel pack extension ports in the gravel pack service tool 52.

When in the reverse flow position, a stimulation fluid or fluids, e.g. acid-based stimulation fluids, may be pumped into an annulus 80 above the gravel pack packer 46. The appropriate amount of stimulation fluid(s) may be selected according to the volume to be squeezed into the different well zones 26. The gravel pack service tool 52 may then be actuated into a blank position which allows the stimulation fluid(s) to be pumped down annulus 80, through gun drill ports of crossover module 56, and into the interior of tubing 62, as indicated by arrows 82. As further indicated by arrows 84, the stimulation fluid(s) may then be discharged to the multiple well zones 26 via nozzles 66 at the respective nozzle subs 64. The nozzles 66 effectively ensure the stimulation fluid(s) is directed out through the sand screen assembly 38; and the isolation packers 42 and seals 68 ensure the stimulation fluid(s) flow out through ports 30 into the corresponding well zones 26. It should be noted that flow through the bottom of tubing 62 may be blocked by a suitable mechanism 85, such as a ball and ball seat or other appropriate mechanism.

Figure 3:
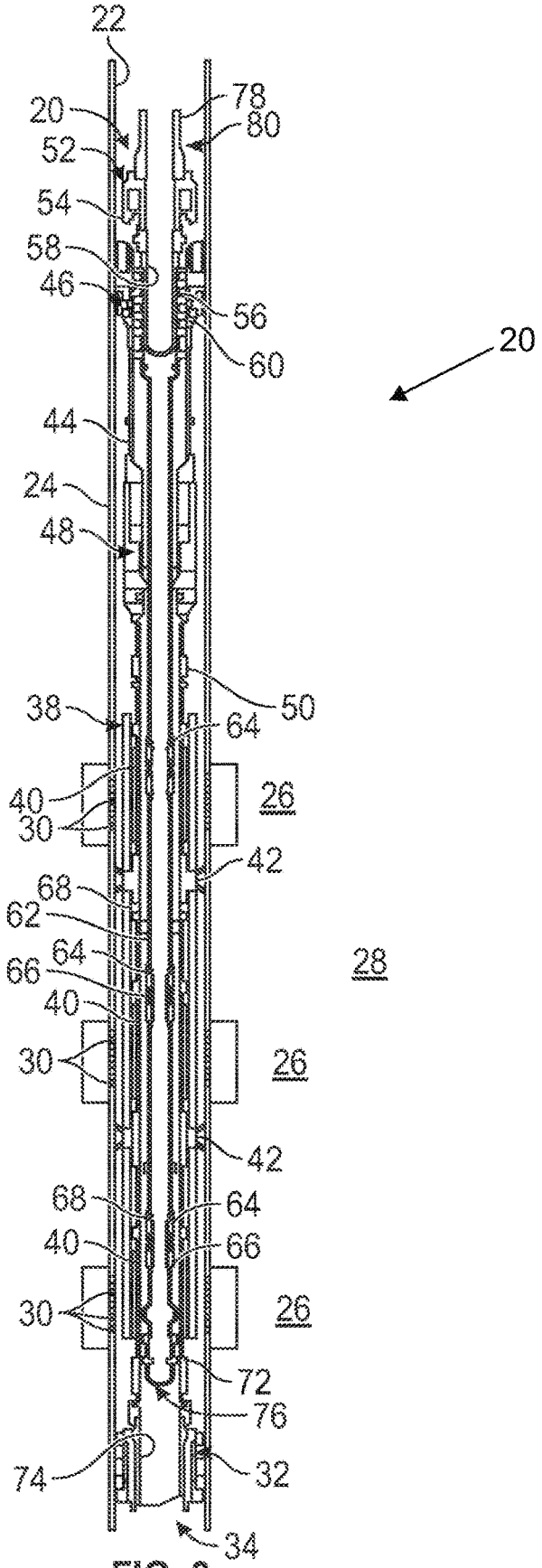
FIG. 3 is an illustration similar to that of FIG. 2 but showing the well string in a different operational position, according to an embodiment of the disclosure.

Subsequently, the gravel pack service tool 52 may be prepared for gravel packing by shifting the service tool 52 to a set down circulation position and actuating the I-slot set down module 58 to the closed position. The I-slot set down module 58 may be actuated by, for example, slacking off weight on tubing/drill pipe 78, as illustrated in FIG. 3. Slacking off weight effectively activates the I-slot set down module 58 and any movement up will shift the I-slot set down module 58 to a closed position so that gravel pack operations may be commenced by pumping gravel slurry down through the interior of gravel pack service tool 52.

Figure 4:
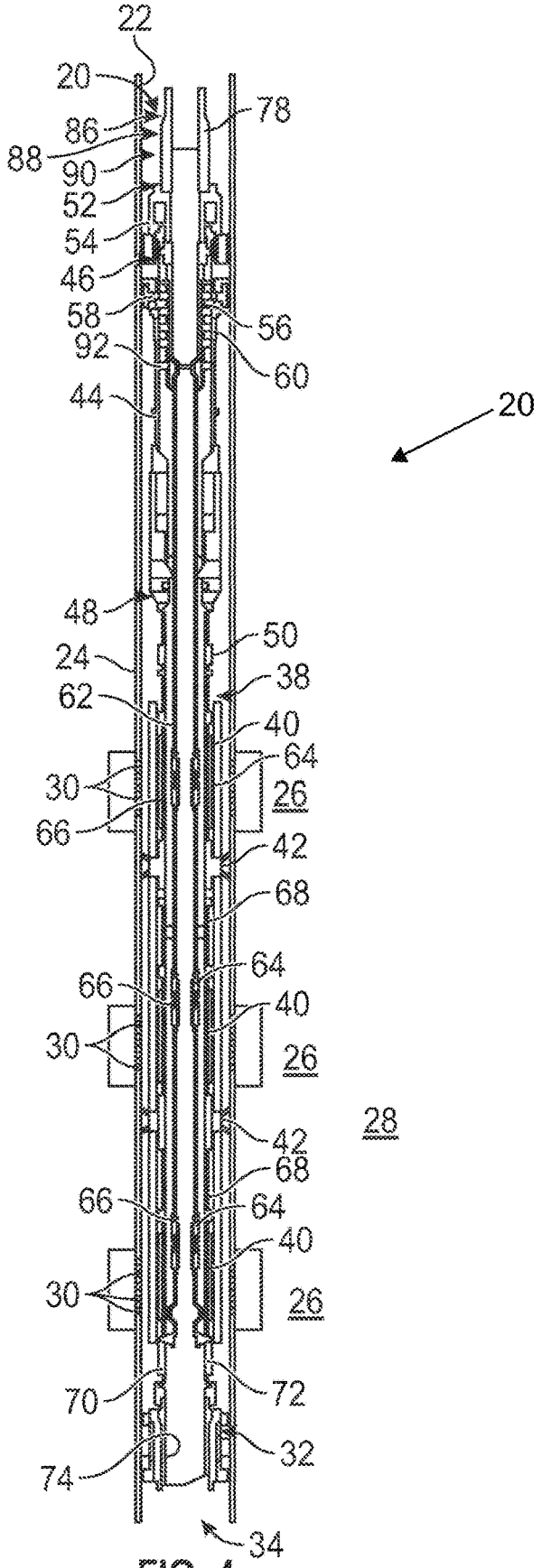
FIG. 4 is an illustration of another example of a well string deployed in a borehole for use in a multizone stimulation and gravel packing operation, according to an embodiment of the disclosure.

Referring generally to FIG. 4, another embodiment of well system 20 is illustrated. In this embodiment, many of the components and features are the same or similar to those described above with reference to FIGS. 1-3 and have been labeled with common reference numerals. In the example illustrated in FIG. 4, additional components include a dual valve system 86 which may be coupled to a top end of the gravel pack service tool 52. The dual valve system 86 may comprise a circulation valve 88 and a ball valve 90. One example of dual valve system 86 which may be used is the intelligent remote dual valve (IRDV) available from Schlumberger Corporation. Another additional component in this example includes a ball seat sub 92 which may be coupled with the crossover module 56. There are various suitable ball seat subs 92 available, e.g. a rotational ball seat sub or other suitable ball seat subs for use with appropriate balls/plugs. It should be noted that some crossover modules utilize a ball seat in a crossover port body, but the ball seat sub 92 is used in place of such a ball seat in the crossover port body. The ball seat sub 92 may be utilized by dropping a suitable ball, e.g. a spherical ball or plug, to selectively block flow along the interior of tubing 62.

In an operational example utilizing the embodiment of FIG. 4, the well string/equipment is run in hole via tubing 78, e.g. drill pipe, to a treatment depth. The bottom hole assembly 34 is coupled into the lower packer 32 where depth may be confirmed. It should be noted the I-slot set down module 58 is again initially locked in an open position and later activated prior to commencing gravel pack operations. Once the proper depth is confirmed, a rig up of surface lines and a pressure test of the lines may be performed. At this stage, a setting sequence may be started for gravel pack packer 46 by blocking fluid flow down through the interior of gravel pack service tool 52 to enable pressuring up for setting packer 46.

The blocking of flow along the interior of gravel pack service tool 52 may be achieved via a setting ball, e.g. a plug, allowed to gravitate and reach an appropriate ball seat located in ball seat sub 92 or at another suitable location. An example of a gravel pack packer setting sequence comprises pressuring up at increments, e.g. 500 psi increments, to a predetermined set pressure and then holding the set pressure for a predetermined time period, e.g. 15 minutes. A pull push test may then be performed to ensure the gravel pack packer 46 has been properly set. A packer back side pressure test also may be performed.

At the next stage, the gravel pack service tool 52 may be released from gravel pack packer 46 by pressuring up to an increased pressure level within the gravel pack service tool. By way of example, the pressure level may be increased to 2800 psi or other suitable pressure and held for a predetermined time period, e.g. five minutes, before bleeding off the pressure. This sequence releases the gravel pack service tool 52 and the release may be confirmed by pulling up on the service tool 52. It should be noted that the various pressure levels and time periods for setting the packer, testing the packer, releasing the service tool, or performing other tasks are again provided merely as examples and other pressure levels and time periods may be utilized depending on the various parameters of the equipment and operation.

Figure 5:
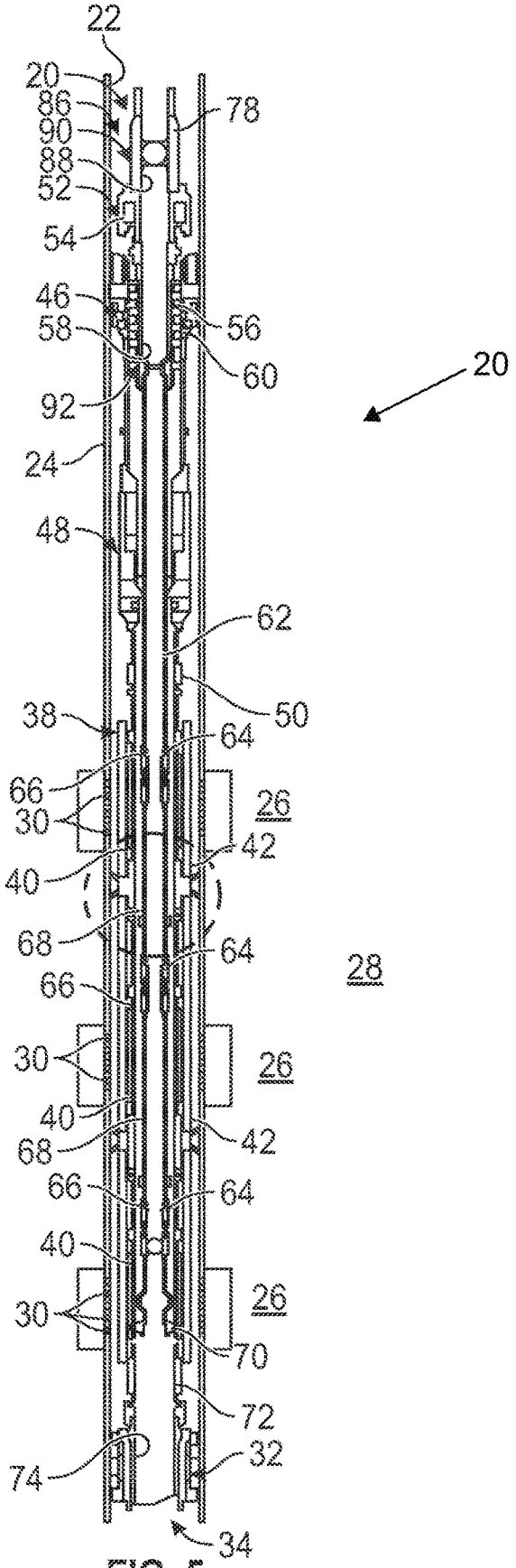
FIG. 5 is an illustration similar to that of FIG. 4 but showing the well string in a different operational position, according to an embodiment of the disclosure.

In FIG. 5, the gravel pack service tool 52 is illustrated as released from gravel pack packer 46. At this stage, different tool positions of service tool 52 may be identified, and then the gravel pack service tool 52 may be placed in a blank position. Increased pressure may then be applied to blow the ball seat and to thus push the ball through the ball seat so that fluid flow may be conducted down through the interior of tubing 62. A ball 94 may be allowed to gravitate and seat on a corresponding ball seat of the last nozzle sub 64, as illustrated in FIG. 5.

At this stage, the ball valve 90 of dual valve system 86 is closed and the circulation valve 88 is opened to facilitate displacement of stimulation fluid down along the interior of tubing 62. Subsequently, the circulation valve 88 is closed and the ball valve 90 is opened to enable squeezing of the stimulation fluid, e.g. acid-based fluid, to be pumped into the multiple well zones 26 via nozzles 66 at the respective nozzle subs 64. The nozzles 66 effectively ensure the stimulation fluid(s) is directed out through the sand screen assembly 38; and the isolation packers 42 and seals 68 ensure the stimulation fluid(s) flow out through ports 30 into the corresponding well zones 26. The pressure may then be increased to blow the ball seat on the last nozzle sub 64 and to thus allow the ball 94 to gravitate downhole.

Figure 6:
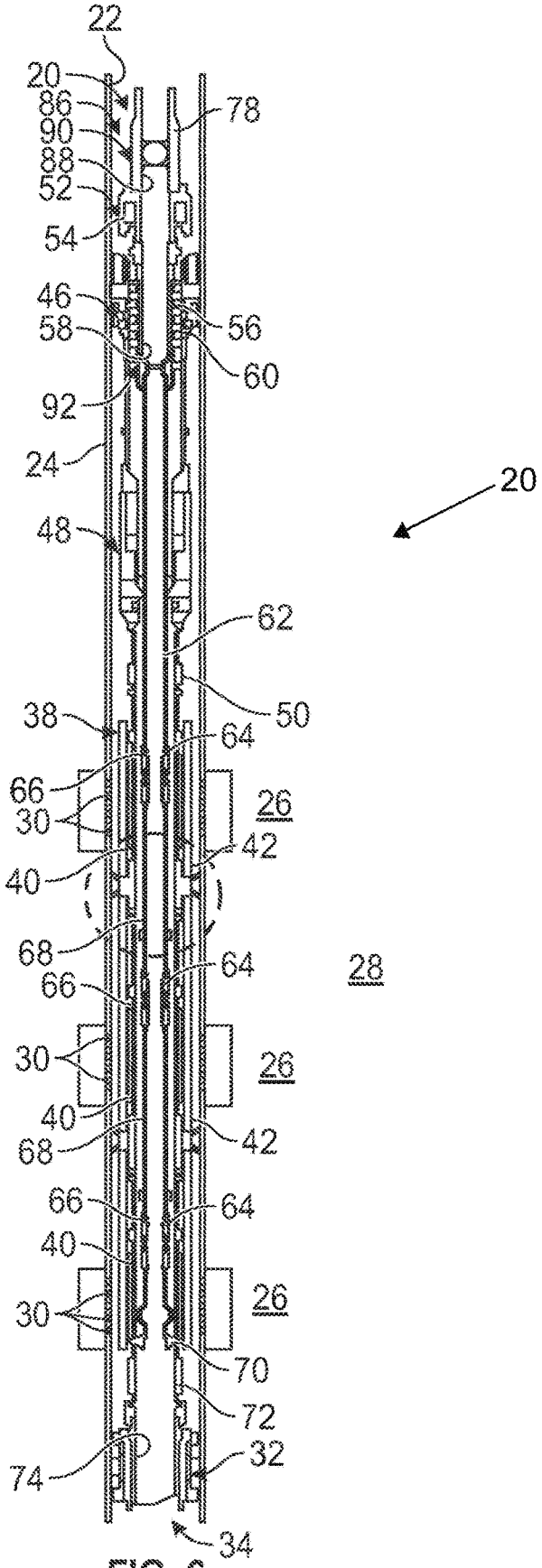
FIG. 6 is an illustration similar to that of FIG. 5 but showing the well string in a different operational position, according to an embodiment of the disclosure.

Subsequently, the gravel pack service tool 52 may be prepared for gravel packing by shifting the service tool 52 to a set down circulation position and actuating the I-slot set down module 58. The I-slot set down module 58 may be actuated by, for example, slacking off weight on tubing/drill pipe 78, as illustrated in FIG. 6. At this stage, the gravel pack service tool 52 may be picked up and shifted to a reverse flow position. A plug or other suitable ball may then be dropped into engagement with the profile on the crossover module 56 and pressure may be applied to convert the crossover module 56 to a flow position for gravel packing operations. The gravel pack service tool 52 may then again be shifted to the set down circulation position and gravel packing operations may be performed.

Figure 7:
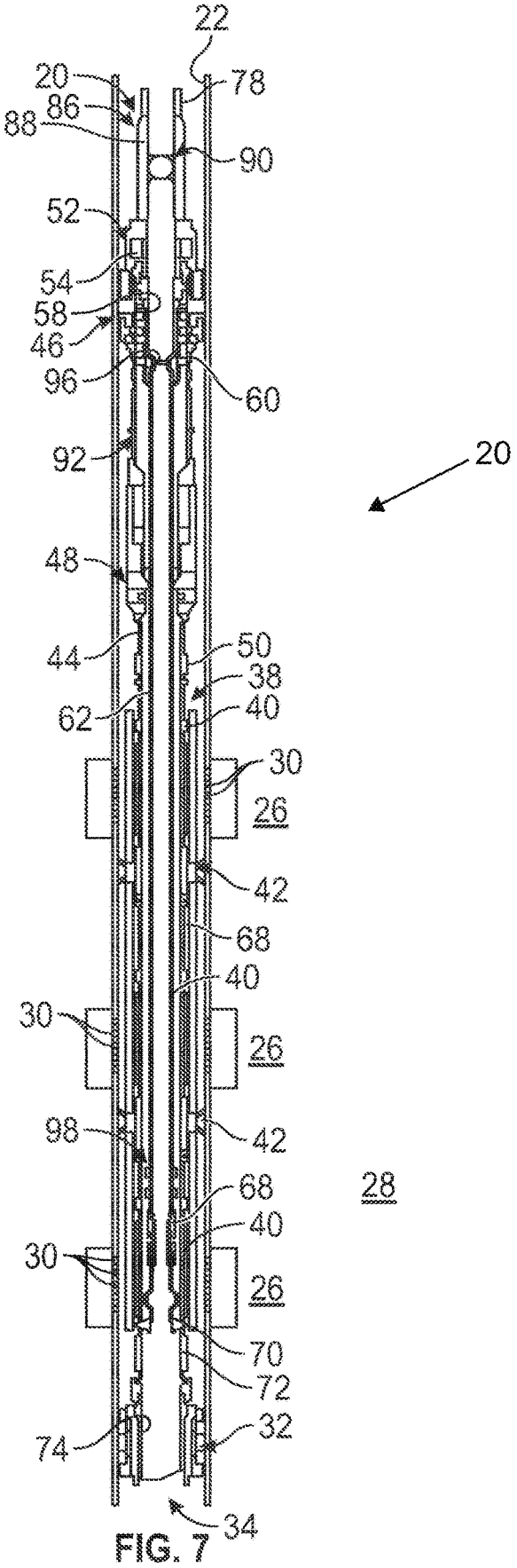
FIG. 7 is an illustration of another example of a well string deployed in a borehole for use in a multizone stimulation and gravel packing operation, according to an embodiment of the disclosure.

Referring generally to FIG. 7, another embodiment of well system 20 is illustrated. In this embodiment, many of the components and features are the same or similar to those described above with reference to FIGS. 4-6 and have been labeled with common reference numerals. In the example illustrated in FIG. 7, the dual valve system 86 is again employed and coupled to a top end of the gravel pack service tool 52. The dual valve system 86 comprises circulation valve 88 and ball valve 90. As discussed above, one example of dual valve system 86 which may be used is the intelligent remote dual valve (IRDV) available from Schlumberger Corporation. Additionally, ball seat sub 92 may again be coupled with the crossover module 56. The ball seat sub 92 may be utilized for setting of gravel pack packer 46 and releasing of service tool 52 by dropping a suitable ball, e.g. a plug or other suitable ball, to selectively block flow along the interior of tubing 62.

In this embodiment, additional components include a sleeve 96 positioned in the crossover module 56 to selectively block or allow crossover flow through the crossover module 56. In some embodiments, the sleeve 96 may be shifted from a flow blocking position to a crossover flow position via a plug or other suitable ball. Additionally, a wash pipe ball drop sleeve 98 is positioned toward the bottom of wash pipe/tubing 62 and is used in place of nozzle subs 64. The ball drop sleeve 98 may be opened by dropping a suitable ball 100 (see FIGS. 8 and 9) and applying a suitable pressure down through tubing 62.

In an operational example utilizing the embodiment of FIG. 7, the well string/equipment is run in hole via tubing 78, e.g. drill pipe, to a treatment depth. The bottom hole assembly 34 is coupled into the lower packer 32 where depth may be confirmed. It should be noted the I-slot set down module 58 is again initially locked in an open position and later activated prior to commencing gravel pack operations. Once the proper depth is confirmed, a rig up of surface lines and a pressure test of the lines may be performed. At this stage, a setting sequence may be started for gravel pack packer 46 by blocking fluid flow down through the interior of gravel pack service tool 52 to enable pressuring up for setting of packer 46.

The blocking of flow along the interior of gravel pack service tool 52 may be achieved via a setting ball allowed to gravitate and reach an appropriate ball seat in ball seat sub 92 or at another suitable location. An example of a gravel pack packer setting sequence comprises pressuring up at increments, e.g. 500 psi increments, to a predetermined set pressure and then holding the set pressure for a predetermined time period, e.g. 15 minutes. A pull push test may then be performed to ensure the gravel pack packer 46 has been properly set. A packer back side pressure test also may be performed.

At the next stage, the gravel pack service tool 52 may be released from gravel pack packer 46 by pressuring up to an increased pressure level within the gravel pack service tool. By way of example, the pressure level may be increased to 2800 psi or other suitable pressure and held for a predetermined time period, e.g. five minutes, before bleeding off the pressure. This sequence releases the gravel pack service tool 52 and the release may be confirmed by pulling up on the service tool 52. It should again be noted that the various pressure levels and time periods for setting the packer, testing the packer, releasing the service tool, or performing other tasks are provided merely as examples and other pressure levels and time periods may be utilized depending on the various parameters of the equipment and operation.

Figure 8:
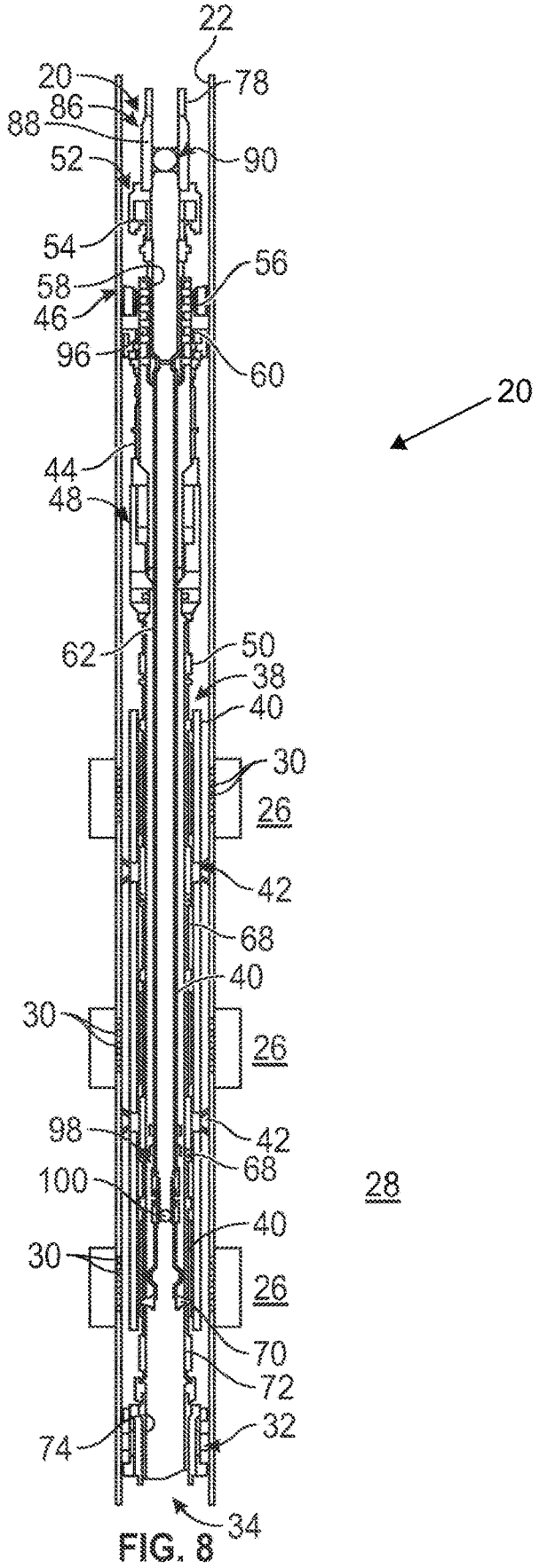
FIG. 8 is an illustration similar to that of FIG. 7 but showing the well string in a different operational position, according to an embodiment of the disclosure.

In FIG. 8, the gravel pack service tool 52 is illustrated as released from gravel pack packer 46. At this stage, different tool positions of service tool 52 may be identified, and then the gravel pack service tool 52 may be placed in a reverse flow position. Increased pressure may then be applied to blow the ball seat and to thus remove the ball and/or ball seat so that fluid flow may be conducted down through the interior of tubing 62. In this case, the ball used may be ball 100 which is then allowed to gravitate down to wash pipe ball drop sleeve 98. Pressure is then applied to open the ball drop sleeve 98 to enable lateral flow through ports in ball drop sleeve 98 to an exterior of pipe 62. (See FIG. 8).

Figure 9:
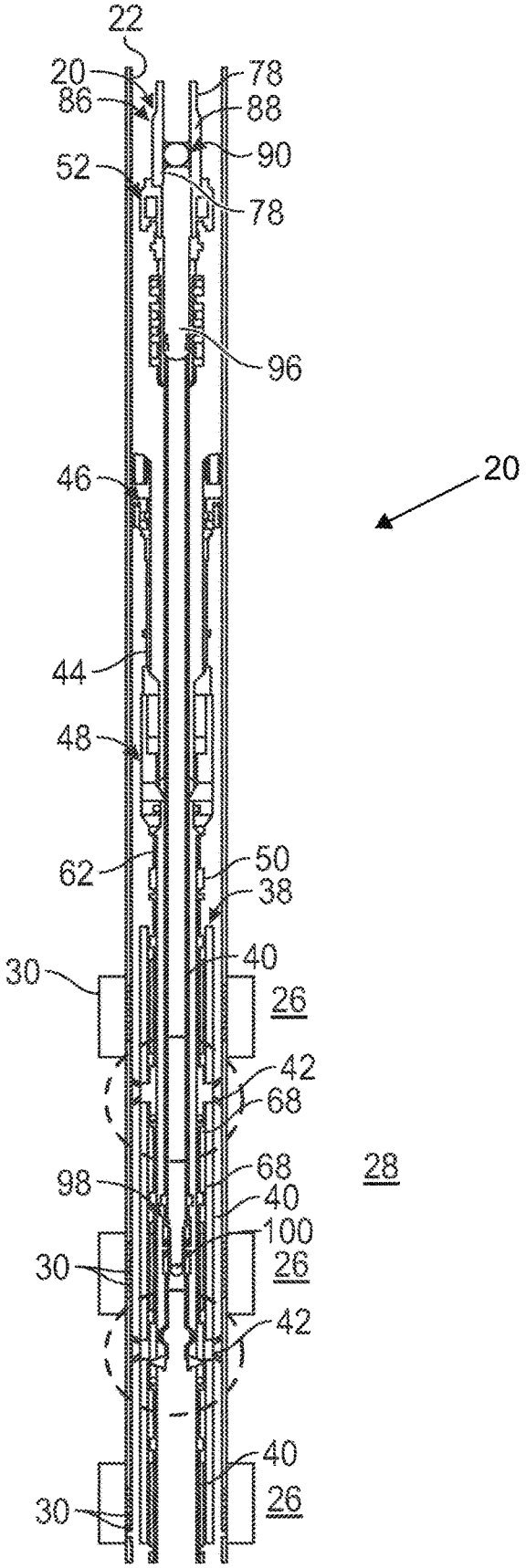
FIG. 9 is an illustration similar to that of FIG. 8 but showing the well string in a different operational position, according to an embodiment of the disclosure.

At this stage, the ball valve 90 of dual valve system 86 is closed and the circulation valve 88 is opened to facilitate displacement of stimulation fluid down along the interior of tubing 62. Subsequently, the circulation valve 88 is closed and the ball valve 90 is opened to enable squeezing of the stimulation fluid, e.g. acid-based fluid, to the bottom well zone 26 where it is displaced outwardly through the ball drop sleeve 98. Effectively, the stimulation fluid flows out of ball drop sleeve 98 and then out through the sand screen assembly 38 into the bottom well zone 26. The isolation packers 42 and the seals 68 ensure the stimulation fluid(s) flow out through ports 30 into the corresponding bottom well zone 26. The service tool 52 may then be picked up to move the ball drop sleeve 98 to the next sequential well zone 26, as illustrated in FIG. 9.

At this stage, the ball valve 90 of dual valve system 86 is again closed and the circulation valve 88 is again opened to facilitate displacement of stimulation fluid down along the interior of tubing 62. Subsequently, the circulation valve 88 is closed and the ball valve 90 is opened to enable squeezing of the stimulation fluid into the next sequential well zone 26, i.e. the well zone 26 directly above the bottom well zone 26, where it is displaced outwardly through the ball drop sleeve 98. The stimulation fluid again flows out of ball drop sleeve 98 and then out through the sand screen assembly 38 into the appropriate next sequential well zone 26. The isolation packers 42 and seals 68 once again ensure the stimulation fluid(s) flow out through ports 30 into the appropriate, next sequential well zone 26. The service tool 52 may then be picked up to move the ball drop sleeve 98 to the next sequential well zone 26 and the process may be repeated until all of the well zones 26 have been treated.

Figure 10:
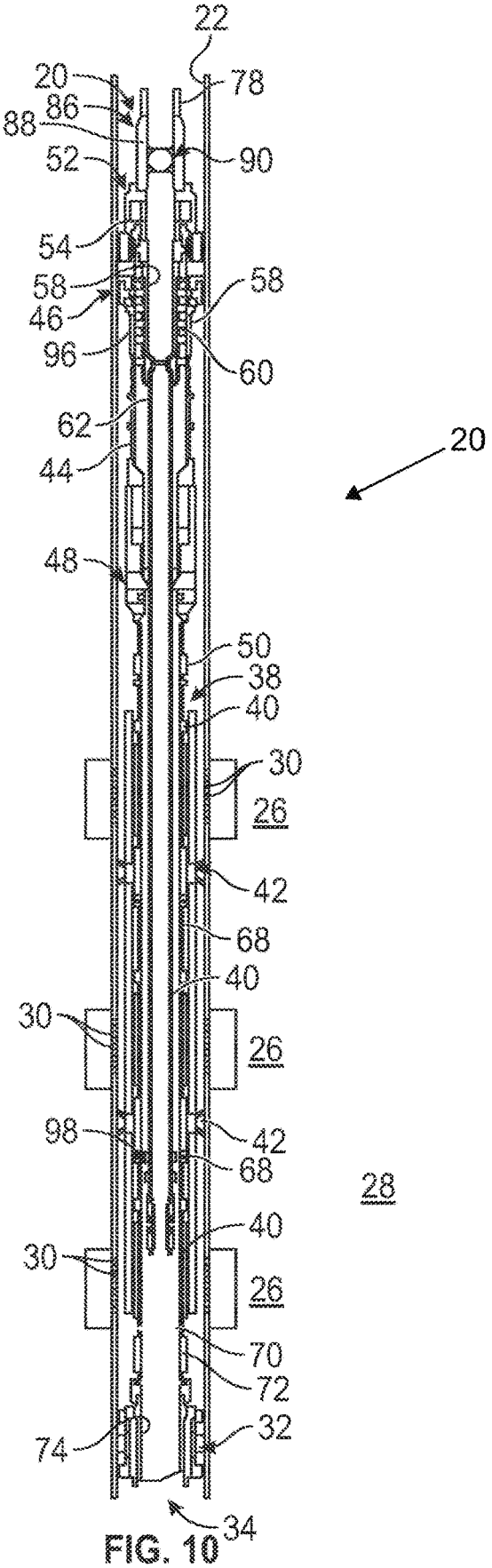
FIG. 10 is an illustration similar to that of FIG. 9 but showing the well string in a different operational position, according to an embodiment of the disclosure.

Subsequently, the gravel pack service tool 52 may be prepared for gravel packing by shifting the service tool 52 to a set down circulation position and actuating the I-slot set down module 58. The I-slot set down module 58 may be actuated by, for example, slacking off weight on tubing/drill pipe 78, as illustrated in FIG. 10. At this stage, the gravel pack service tool 52 may be picked up and shifted to a reverse flow position. A plug or other suitable ball may then be employed to convert the crossover module 56 to a flow position for gravel packing operations. The gravel pack service tool 52 may then again be shifted to the set down circulation position and gravel packing operations may be performed.

Depending on the parameters of a given environment, stimulation operation, and gravel packing operation, the well equipment may comprise a variety of other and/or additional components. Similarly, the size and configuration of components described herein may be adjusted to accommodate such parameters or to provide additional or other functionality. Furthermore, a variety of balls, e.g. plugs, may be used for shifting various components. Similarly, various types of packers and seal elements may be used to provide the desired isolation with respect to the well zones. The techniques described herein may be used to enable single trip stimulation and gravel packing in multiple well zones, and the multiple well zones may comprise two well zones, three well zones, and sometimes substantially larger numbers of well zones. Additionally, acid-based stimulation fluids may be employed or many other types of stimulation fluids depending on the surrounding formation and the goals of the stimulation operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for use in a well, comprising:

positioning a gravel pack service tool in a well string;

deploying the well string downhole into a wellbore drilled into a multilayered reservoir having a plurality of well zones;

isolating sections of the well string at the plurality of well zones;

delivering a stimulation fluid into each well zone of the plurality of well zones while the well string remains downhole; actuating the gravel pack service tool to a gravel pack position; and performing a gravel packing operation in the wellbore while the well string remains downhole, wherein delivering the stimulation fluid comprises either:

utilizing a plurality of nozzle subs deployed along a wash pipe extending down from the gravel pack service tool, or utilizing a wash pipe ball drop sleeve to control delivery of the stimulation fluid to individual well zones sequentially.

2. The method as recited in claim 1, wherein delivering comprises delivering an acid-based stimulation fluid.

3. The method as recited in claim 1, wherein delivering comprises delivering the stimulation fluid to the plurality of well zones simultaneously.

4. The method as recited in claim 1, wherein delivering comprises delivering the stimulation fluid to the plurality of well zones sequentially.

5. The method as recited in claim 4, further comprising lifting the gravel pack service tool along with a wash pipe deployed below the gravel pack service tool to enable sequential stimulation of the plurality of well zones.

6. The method as recited in claim 1, wherein deploying comprises deploying the well string into a multilateral reservoir having at least two well zones.

7. The method as recited in claim 1, wherein deploying comprises deploying the well string into a multilateral reservoir having at least three well zones.

8. A method, comprising:

running a well string downhole into a wellbore and through at least three well zones disposed along the wellbore, wherein running the well string downhole comprises:

running a sand screen assembly downhole on an outer tubing; and running a wash pipe downhole while located within the outer tubing and while coupled with a gravel pack service tool;

locating a plurality of nozzle subs along the wash pipe;

while the well string is downhole, stimulating the at least three well zones by squeezing a stimulation fluid into the at least three well zones;

following the stimulating, actuating the well string to a gravel pack position; and gravel packing the wellbore prior to withdrawing equipment of the well string from the wellbore.

9. The method as recited in claim 8, wherein stimulating comprises delivering the stimulation fluid to the at least three well zones simultaneously.

10. A system, comprising:

a well string having downhole equipment arranged to enable a multi zone stimulation operation followed by a gravel packing operation during a single trip downhole, the downhole equipment comprising:

a screen assembly carried on an outer tubing and having a plurality of screens positioned to enable fluid communication with a plurality of corresponding well zones;

an inner tubing having features therealong to enable injection of stimulation fluid into the plurality of corresponding well zones during the single trip downhole, wherein the features along the inner tubing comprise a ball drop sleeve movable to corresponding well zones of the plurality of corresponding well zones to enable sequential discharge of stimulation fluid into the corresponding well zones;

a plurality of isolation devices including a gravel pack packer; and a gravel pack service tool received in the gravel pack packer and coupled with the inner tubing, the gravel pack service tool being actuatable between positions which enable stimulation of multiple well zones and a subsequent gravel packing operation while remaining downhole.

* * * * *